US007225784B2

(12) United States Patent
Takano

(10) Patent No.: US 7,225,784 B2
(45) Date of Patent: Jun. 5, 2007

(54) OIL SUPPLY APPARATUS

(75) Inventor: Hirohisa Takano, Handa (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/376,120

(22) Filed: Mar. 16, 2006

(65) Prior Publication Data

US 2006/0207542 A1 Sep. 21, 2006

(30) Foreign Application Priority Data

Mar. 18, 2005 (JP) ..... 2005-079079

(51) Int. Cl.
*F02B 75/06* (2006.01)
*F01M 1/02* (2006.01)

(52) U.S. Cl. ..... 123/192.2; 123/196 R

(58) Field of Classification Search ..... 123/196 R, 123/192.2

See application file for complete search history.

(56) References Cited

FOREIGN PATENT DOCUMENTS

| | | | |
|---|---|---|---|
| EP | 1 484 488 A1 | | 3/2003 |
| JP | 63246528 A | * | 10/1988 |
| JP | 03-237207 | | 10/1989 |
| JP | 07189727 A | * | 7/1995 |
| JP | 2003-269186 | | 3/2002 |
| JP | 2004-143952 | | 10/2002 |

* cited by examiner

*Primary Examiner*—Stephen K. Cronin
*Assistant Examiner*—Hyder Ali
(74) *Attorney, Agent, or Firm*—Reed Smith LLP; Stanley P. Fisher, Esq.; Juan Carlos A. Marquez, Esq.

(57) ABSTRACT

A oil supply apparatus includes a pair of balancer shafts arranged at an upper space of an oil pan provided at a lower part of an engine, a scavenge pump activated by one of the pair of balancer shafts, and a feed pump activated by the other of the pair of balancer shafts.

15 Claims, 3 Drawing Sheets

OIL SUPPLY APPARATUS

This application is based on and claims priority under 35 U.S.C. § 119 to Japanese Patent Application 2005-079079, filed on Mar. 18, 2005, the entire content of which is incorporated herein by reference.

FIELD OF THE INVENTION

This invention relates to a oil supply apparatus which includes a pair of balancer shafts in an upper space of an oil pan provided at a lower portion of an engine.

BACKGROUND

Known oil supply apparatuses are disclosed in JP2003269186A (see columns 0017–0031, FIGS. 2–6) and JP2004143952A (see columns 0012–0016, FIGS. 1–3). With the configuration of the oil supply apparatus disclosed in JP2003269186A, oil, which is stored in an oil pan provided at a lower portion of an engine, is sucked by means of an oil pump through a strainer, and supplied to each part of an engine.

The oil supply apparatus disclosed in JP2003269186A is provided with a balancer housing in the oil pan in order to form a space into which an intrusion of the oil from the oil pan is prevented. A pair of balancer shafts is arranged in parallel relative to the space of the engine, and one of the pair of balancer shafts activates the oil pump. According to the oil supply apparatus disclosed in JP2003269186A, the balancer housing is formed with an oil discharge hole at a side portion thereof. The oil discharge hole is arranged at a position higher than an oil level of the oil in the oil pan. The oil flowed into the balancer housing is lifted by means of a drive gear or a balancer weight of the balancer shaft, and is fed back to the oil pan through the oil discharge hole.

With the configuration of the oil supply apparatus disclosed in JP2004143952A, the oil pan is attached to a lower crankcase, and is provided with a bottom separate wall portion in an interior space thereof. Further the oil supply apparatus includes a scavenge pump and a feed pump at a lower portion of the engine. The scavenge pump and the feed pump are driven by means of a common drive shaft. The oil, which is fallen after lubricating a bearing of the crankshaft and a piston, is collected in the bottom separate wall portion. Then, the oil is sucked by means of the scavenge pump through a suck pipe, and injected as an oil jet from a discharge pipe, and then the oil is fallen into the oil pan. Further, the oil stored in the oil pan is sucked by means of the feed pump through an intake pipe, and is passed through an oil filter, and then is supplied to each part of the engine.

With the configuration of the oil supply apparatus disclosed in JP2003269186A, the balancer shafts are arranged in an interior space of the balancer housing, and the oil in the balancer housing is lifted out during rotation of the balancer shafts. With such configuration, the balancer shafts may occasionally be applied with a rotational load caused by the oil. In order to prevent the balancer shafts from being applied with the rotational load caused by the oil, the oil supply apparatus disclosed in JP2003269186A sucks the oil in the bottom separate wall portion by means of the scavenge pump.

However, because the oil supply apparatus disclosed in JP2003269186A activates the scavenge pump and the feed pump by means of the common drive shaft, two pumps having a different function are arranged close to each other.

Therefore, a structure of the pump, an oil passage, or the like, may occasionally be complicated.

A need thus exists for a oil supply apparatus, which reasonably activates the scavenge pump and the feed pump in the engine having a pair of balancer shafts.

SUMMARY OF THE INVENTION

According to an aspect of the present invention, a oil supply apparatus includes a pair of balancer shafts arranged at an upper space of an oil pan provided at a lower part of an engine, a scavenge pump activated by one of the pair of balancer shafts, and a feed pump activated by the other of the pair of balancer shafts.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
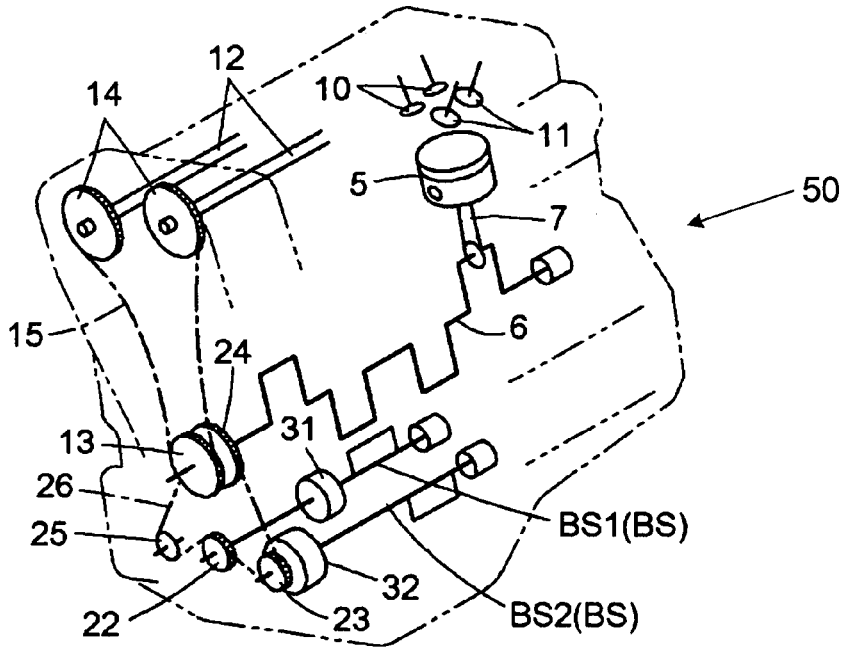
FIG. 1 is a schematic view of an engine.
Figure 2:
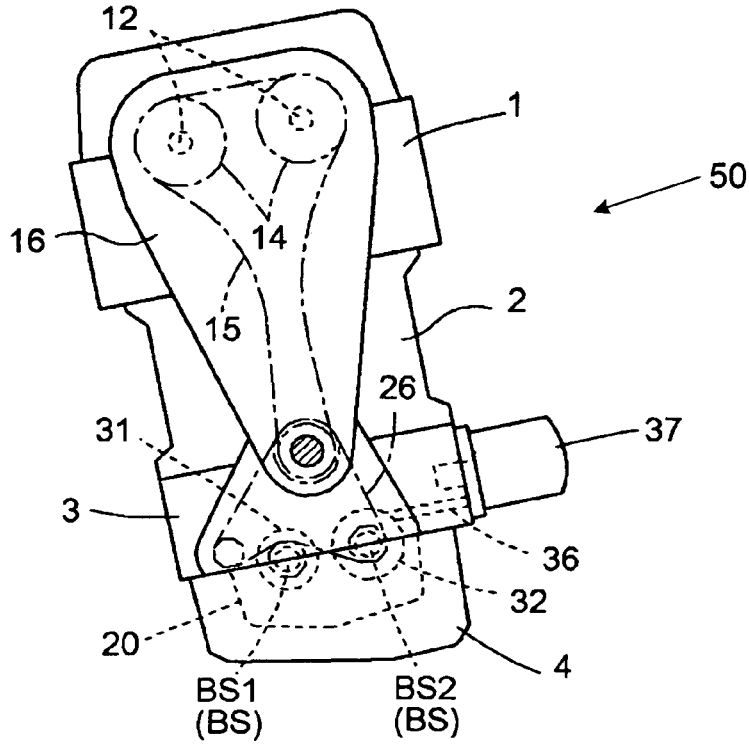
FIG. 2 is a side view of the engine.
Figure 3:
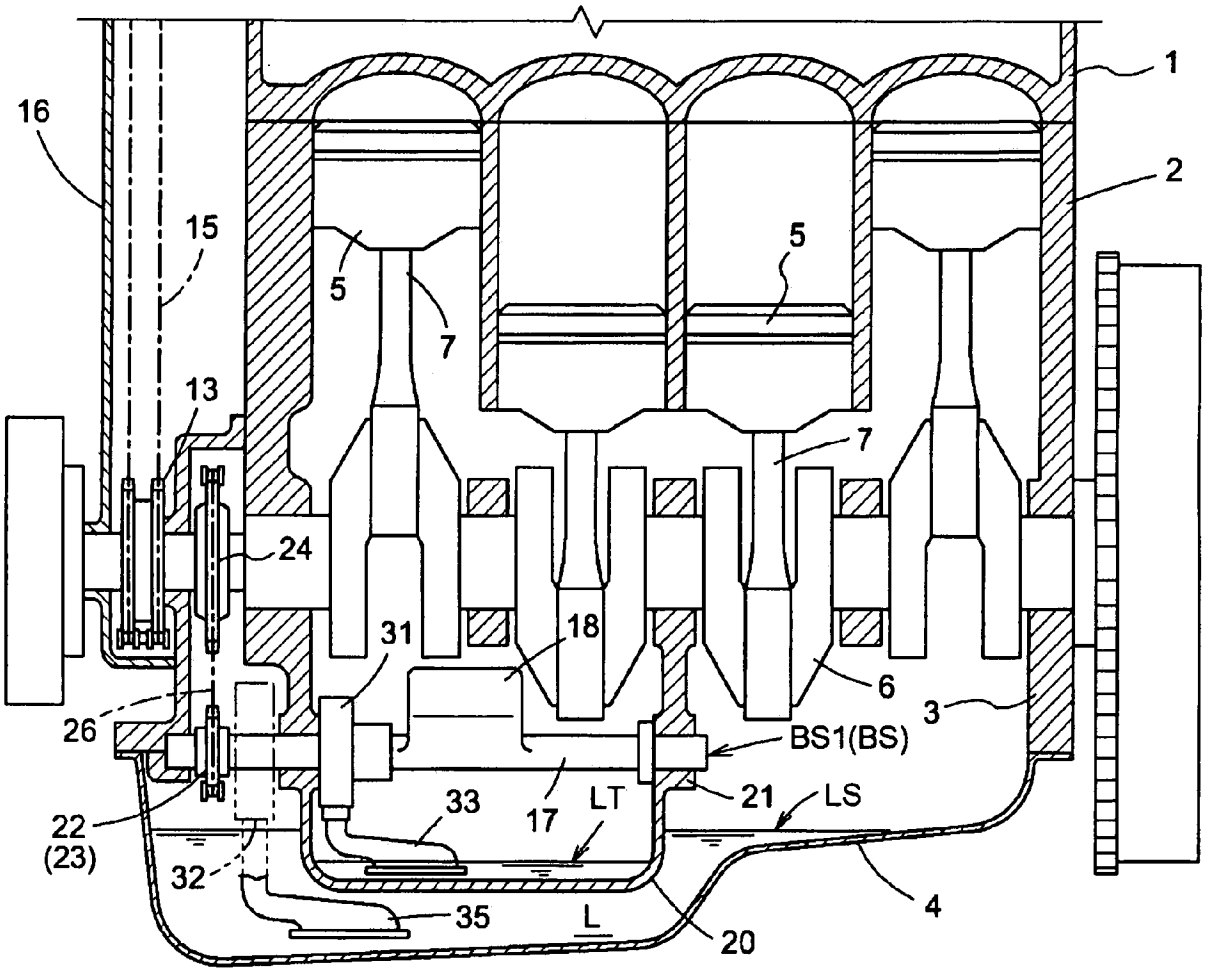
FIG. 3 is a longitudinal front view of a lower portion of the engine.

An embodiment of the present invention will be explained hereinbelow with reference to the attached drawings. As illustrated in FIGS. 1–2, an internal combustion engine 50 for a vehicle includes a cylinder head 1, a cylinder block 2, a crankcase 3, an oil pan 4, a piston 5, a crankshaft 6, and a connecting rod 7. The cylinder head 1, the cylinder block 2, the crankcase 3, and the oil pan 4 are arranged from the top to the bottom. The piston 5 is slidably housed in a cylinder bore of the cylinder block 2, and the crankshaft 6 is rotatably supported at the crankcase 3. Further, the piston 5 and the crankshaft 6 are connected by means of the connecting rod 7.

The cylinder head 1 includes an inlet valve 10 and an exhaust valve 11, both of which can freely be opened and closed. The cylinder head 1 further includes a pair of camshafts 12 for opening and closing the valves 10 and 11. The cylinder block 2 is formed with a space for lubricating, cooling water at an outer circumferential portion of the cylinder bore (not shown). Further, the cylinder block 2 is provided with a water pump for lubricating the cooling water in the cylinder block 2 or for lubricating the cooling water between the cylinder block 2 and an exterior radiator (not shown).

As illustrated in FIGS. 1–5, a timing chain 15 is wound around a sprocket 13 and a first input sprocket 14. A chain cover 16 covers the timing chain 15, the sprocket 13, and the first input sprocket 14. The crankshaft 6 of the crankcase 3 includes the sprocket 13 at an end portion thereof, and the pair of camshafts 12 includes the first input sprocket 14. However, the present invention is not limited to a structure with the timing chain 15. Alternatively, or in addition, the present invention may include a structure in which a rotational power synchronized with a rotation of the crankshaft 6 is transmitted to the pair of camshafts 12 by means of a timing belt or gear synchronization.

The oil pan 4 is formed with a storage space for oil L for lubricating and cooling and so on. Further, the oil pan 4 is provided with a separate wall portion 20 at an upper space thereof in such a manner that a bottom portion of the separate wall portion 20 is positioned below an oil level LS of the oil L stored in the oil pan 4. Two balancer shafts BS is provided at an interior space of the separate wall portion 20. According to the embodiment of the present invention, the oil pan 4 is made of a pressed iron material, and the separate wall portion 20 is made of an aluminum alloy casting.

Each balancer shaft BS includes respectively a shaft portion 17 and a balancer portion 18 for countering unbalance of the engine, which is provided eccentrically relative to an axial center of the shaft portion 17. A support block 21 is attached at a lower surface of the crankcase 3 for supporting the pair of balancer shafts BS rotatably, and is housed in the separate wall portion 20. The separate wall portion 20 is provided between the two balance shafts BS1, BS2 and the oil pan, and includes a bottom portion and a side portion, which encloses the bottom portion. Further, the separate wall portion 20 includes a substantially tray shape and opens upward. Because of such structure, the oil L falls into the interior space of the separate wall portion 20 after lubricating an inner surface of a cylinder of the crankcase 3, or the like, and is stored in the interior space of the separate wall portion 20. In a condition where the oil L is stored in the interior space of the separate wall portion 20, the balancer shafts BS may be interfered with the oil L, a rotation of the balancer shafts BS may occasionally be interrupted, and the balancer shafts BS may be applied with a load. A oil supply apparatus according to the embodiment of the present invention includes the below explained structure for discharging the oil L in the interior space of the separate wall portion 20.

Because the whole engine 50 is arranged in an inclined manner viewing from a direction along an axial center of the crankshaft 6, a level difference between the pair of balancer shafts BS originates in the inclined engine arrangement, and a part of a bottom portion of the oil pan 4 protrudes downward. In order to restrain such protrusion of the bottom portion of the oil pan 4, a lowest protruded part of the bottom portion of the oil pan 4 is formed in a horizontal condition. Further, because the whole separate wall portion 20 is also inclined, a part of the separate wall portion 20 facing a horizontal part of the bottom portion of the oil pan 4, (a lowest part of the separate wall portion 20) is formed in a horizontally flat shape.

One of the pair of balancer shafts BS arranged at a lower level side (i.e., a first balancer shaft BS1) includes a second input sprocket 22, and the other of the pair of balancer shafts BS arranged at a higher level side (i.e., a second balancer shaft BS2) includes a third input sprocket 23. By winding a drive chain 26 around the input sprockets 22 and 23, a drive sprocket 24 of the crankshaft 6, and an idle sprocket 25, the pair of balancer shafts BS1 and BS2 is synchronously rotated in a constant speed. On this occasion, each balancer shaft rotates in an opposite direction. Alternatively, or in addition, the present invention may include plural gears or the timing belt for transmitting a power from the crankshaft 6 to the pair of balancer shafts BS1 and BS2.

The first balancer shaft BS1 is provided with a scavenge pump 31, which is connected to a first shaft portion 17 thereof for driving, and the second balancer shaft BS2 is provided with a feed pump 32, which is connected to a second shaft portion 17 thereof for driving.

Figure 4:
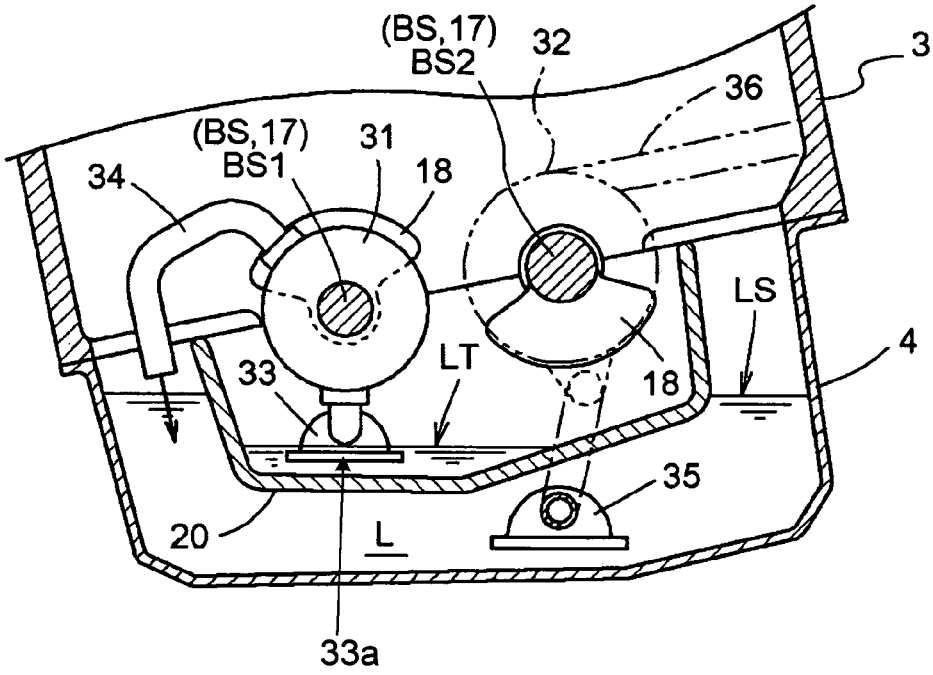
FIG. 4 is a sectional view illustrating a positional relation between an oil pan, a separate wall portion, and balancer shafts.
Figure 5:
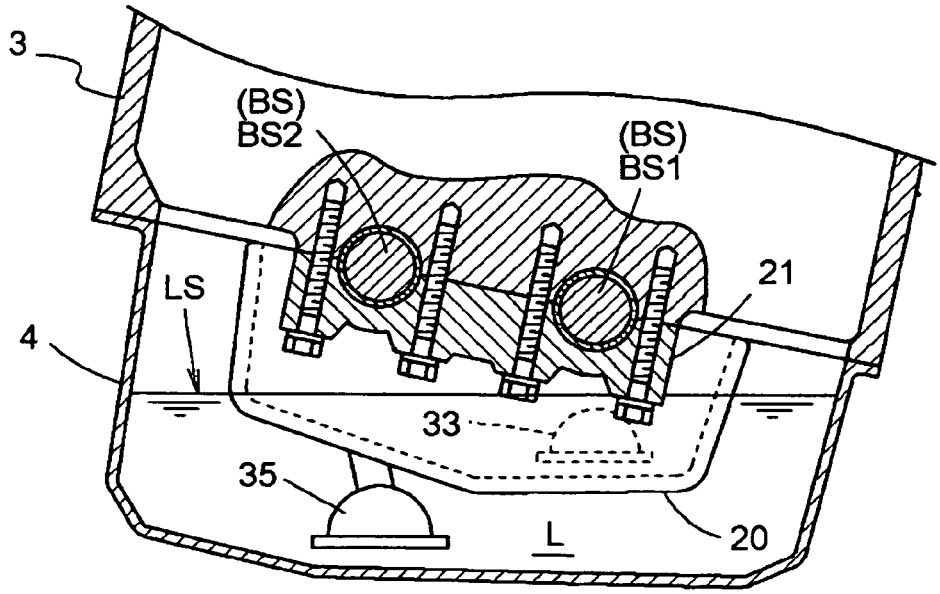
FIG. 5 is a sectional view illustrating a support structure of the balancer shafts.

As illustrated in FIG. 4, a first strainer 33 is provided in the vicinity of a horizontal part of the bottom portion of the separate wall portion 20 (the lowest part of the separate wall portion 20) for sucking the oil L in the interior space of the separate wall portion 20. Further, a first suction oil passage is formed for supplying the oil L from the first strainer 33 to the scavenge pump 31, and a feedback oil passage 34 is formed for feeding back the oil L from the scavenge pump 31 to the oil pan 4. According to the embodiment of the present invention, a suction port 33*a* of the first strainer 33 is arranged at a position below a rotation profile of a first balancer portion 18 of the first balancer shaft BS1. By sucking the oil L by means of the first strainer 33, an oil level LT of the oil L in the interior space of the separate wall portion 20 is lowered so that the oil level LT comes to a level lower than the outer circumference of the balancer portion 18. Accordingly, an interference between the first balancer portion 18 of the first balancer shaft BS1 and the oil L can be prevented and a smooth rotational operation of the first balancer shaft BS1 can be achieved.

As illustrated in FIG. 4, a second strainer 35 is provided in the vicinity of the horizontal part of the bottom portion of the oil pan 4, (a lowest part of the oil pan 4) for sucking the oil L stored in the oil pan 4. Further, a second suction oil passage is formed for supplying the oil L from the second strainer 35 to the feed pump 32, and a supply oil passage 36 is formed for supplying the oil L from the feed pump 32 to an oil filter 37.

The oil L flowed into the interior space of the separate wall portion 20 is fed back to the oil pan 4 by activating the scavenge pump 31 by means of the first balancer shaft BS1. Further, the oil L stored in the oil pan 4 is supplied to each circulation part of the engine 50 or a device to be lubricated through the oil filter 37 by activating the feed pump 32 by means of the second balancer shaft BS2. Accordingly, the oil supply apparatus according to the embodiment of the invention includes a system for supplying the oil L to each circulation part of the engine 50 or the device to be lubricated.

With the configuration of the oil supply apparatus according to the embodiment of the present invention, a vibration of the engine 50 is reduced because of a synchronous rotation of the pair of balancer shafts BS during engine operation. Further, because the scavenge pump 31 and the feed pump 32 are driven during rotational operation of the pair of balancer shafts BS (the first balancer shaft BS1 and the second balancer shaft BS2), the oil L flowed into the interior space of the separate wall portion 20 is fed back to the oil pan 4 by means of the scavenge pump 31, and the oil L stored in the oil pan 4 is supplied to each circulation part of the engine 50 and the device to be lubricated by means of the feed pump 32.

Because the first balancer shaft BS1 is arranged at a lower level than the second balancer shaft BS2, the first balancer shaft 5 positions closer to the bottom portion of the separate wall portion 20 relative to the second balancer shaft BS2. By using the feature of a layout of the pair of balancer shafts BS, a length of the first suction oil passage formed between the scavenge pump 31 and the first strainer 33 can be reduced.

Further, because the first balancer shaft BS1 is arranged in parallel with the second balancer shaft BS2, the scavenge pump 31 is arranged in parallel with the feed pump 32. Therefore, the oil passages from the scavenge pump 31 and the feed pump 32 can be readily formed without interfering with each other.

The present invention is not limited to the embodiment disclosed above. Variations and changes may be made by others.

Alternatively, or in addition, a drive line may be configured such that a power from the first balancer shaft BS1 is transmitted to the scavenge pump 31 through a gear synchronization system. With such configuration, latitude in a layout of the scavenge pump is expanded, and a design of the scavenge pump is eased. Likewise, the drive line may be configured such that a power from the second balancer shaft BS2 is transmitted to the feed pump 32 through the gear synchronization system.

With the configuration of the oil supply apparatus according to the embodiment of the present invention, the one of the pair of balancer shafts activates the scavenge pump and the other of the pair of balancer shafts activates the feed pump. Accordingly, a structure of the drive line is simplified relative to a condition where the scavenge pump and the feed pump are driven by means of a common shaft. Further, the oil passages of the scavenge pump and the feed pump can be arranged without interfering with each other. In consequence, the scavenge pump and the feed pump can reasonably be activated.

With the configuration of the oil supply apparatus according to the embodiment of the present invention, the oil pan is provided with the separate wall portion at the upper space thereof for preventing intrusion of the oil from the oil pan. The suction port of the strainer, which sucks the oil in the interior space of the separate wall portion, is arranged at the position below the rotation locus of the outer circumference of the balancer portion of the balancer shaft, which activates the scavenge pump.

Because the suction port of the strainer is arranged at the position below the rotation locus of the outer circumference of the balancer portion of the balancer shaft, the oil flowed into the interior space of the separate wall portion is supplied to the scavenge pump from the strainer, and the oil level of the oil in the interior space of the separate wall portion is not interfered with the balancer shaft. Therefore, the balancer shaft is not applied with a rotational resistance from the oil. Accordingly, the load applied to the balancer shaft is not increased. Moreover, the balancer shaft can be prevented from unnecessarily agitating the oil.

With the configuration of the oil supply apparatus according to the embodiment of the present invention, the pair of balancer shafts are arranged at a different level, respectively. Further, the one of the pair of balancer shafts arranged at the lower level side activates the scavenge pump.

Because, the balancer shaft, which is arranged closer to the oil level of the oil, activates the scavenge pump, the length of the oil passage at a suction side can be reduced. Accordingly, an oil passage system having a minimum loss can be achieved.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An oil supply apparatus in an internal combustion engine, comprising:

two balancer shafts arranged at an upper space of an oil pan provided at a lower part of the engine and respectively provided with a balancer portion for countering unbalance of the engine;

a scavenge pump driven by one of the two balancer shafts;

a feed pump driven by the other of the two balancer shafts;

a separate wall portion provided between the two balance shafts and the oil pan for preventing intrusion of the oil from the oil pan; and a first strainer having a suction port for sucking the oil in an interior space of the separate wall portion by means of the scavenge pump, wherein the suction port is arranged at a position below a rotation profile of the balancer portion of the balancer shaft which drives the scavenge pump.

2. The oil supply apparatus according to claim 1, wherein the one of the two balancer shafts is arranged lower level than the other of the two balancer shafts.

3. The oil supply apparatus according to claim 1, wherein the separate wall portion includes a bottom portion positioned below an oil level of the oil stored in the oil pan.

4. The oil supply apparatus according to claim 2, wherein the separate wall portion includes a bottom portion positioned below an oil level of the oil stored in the oil pan.

5. The oil supply apparatus according to claim 3, wherein the separate wall portion includes the bottom portion and a side portion which encloses the bottom portion, the separate wall portion further includes a substantially tray shape opening upward, and wherein a support block for supporting the balancer shafts rotatably is housed in the separate wall portion.

6. The oil supply apparatus according to claim 4, wherein the separate wall portion includes the bottom portion and a side portion which encloses the bottom portion, the separate wall portion further includes a substantially tray shape opening upward, and wherein a support block for supporting the balancer shafts rotatably is housed in the separate wall portion.

7. The oil supply apparatus according to claim 2, wherein a level difference between the balancer shafts originates in an engine arrangement in an inclined manner, and wherein a lowest part of the oil pan, which is protruded downward by the inclined engine arrangement, is formed in horizontally flat shape.

8. The oil supply apparatus according to claim 3, wherein a level difference between the balancer shafts originates in an engine arrangement in an inclined manner, and wherein a lowest part of the oil pan, which is protruded downward by the inclined engine arrangement, is formed in horizontally flat shape.

9. The oil supply apparatus according to claim 4, wherein a level difference between the balancer shafts originates in an engine arrangement in an inclined manner, and wherein a lowest part of the oil pan, which is protruded downward by the inclined engine arrangement, is formed in horizontally flat shape.

10. The oil supply apparatus according to claim 5, wherein a level difference between the balancer shafts originates in an engine arrangement in an inclined manner, and wherein a lowest part of the oil pan, which is protruded downward by the inclined engine arrangement, is formed in horizontally flat shape.

11. The oil supply apparatus according to claim 6, wherein a level difference between the balancer shafts originates in an engine arrangement in an inclined manner, and wherein a lowest part of the oil pan, which is protruded downward by the inclined engine arrangement, is formed in horizontally flat shape.

12. The oil supply apparatus according to claim 11, wherein the scavenge pump includes the first strainer for sucking the oil in the interior space of the separate wall portion, a part of the bottom portion of the separate wall portion facing a horizontal part of the oil pan is formed in horizontally flat shape, and wherein the first strainer is arranged in the vicinity of a lowest part of the horizontal part of the separate wall portion.

13. The oil supply apparatus according to claim 12, wherein the scavenge pump includes a feedback oil passage for feeding back the oil to the oil pan from the first strainer provided in the interior space of the separate wall portion.

14. The oil supply apparatus according to claim 13, wherein the feed pump includes a second strainer for sucking the oil stored in the oil pan, and a supply oil passage for supplying the oil to an oil filter from the second strainer.

15. The oil supply apparatus according to claim 14, wherein

The second strainer is arranged in the vicinity of a lowest part of the horizontal part of the oil pan.

* * * * *